US008082679B1

(12) United States Patent
Arnim

(10) Patent No.: US 8,082,679 B1
(45) Date of Patent: Dec. 27, 2011

(54) MAGNETICALLY DIRECTED HAIR DRYER NOZZLE

(76) Inventor: Carol Arnim, Mesquite, NV (US)

( * ) Notice: Subject to any disclaimer, the term of this patent is extended or adjusted under 35 U.S.C. 154(b) by 402 days.

(21) Appl. No.: 12/456,832

(22) Filed: Jun. 22, 2009

(51) Int. Cl.
*A45D 20/12* (2006.01)

(52) U.S. Cl. ..... 34/97; 132/148; 132/271

(58) Field of Classification Search ..... 34/90, 95, 34/96, 97, 99, 100, 101, 114, 80; 132/148, 132/271
See application file for complete search history.

(56) References Cited

U.S. PATENT DOCUMENTS

| | | | | |
|---|---|---|---|---|
| 2,827,060 | A | 3/1958 | Marty | |
| 2,980,340 | A | 4/1961 | McEachern | |
| 3,964,502 | A * | 6/1976 | Komatsu | 132/119.1 |
| 5,546,674 | A | 8/1996 | Lange et al. | |
| 5,689,896 | A | 11/1997 | Smetana | |
| 5,839,451 | A | 11/1998 | Dorber et al. | |
| 5,894,849 | A | 4/1999 | Ehlhardt et al. | |
| 6,393,208 | B1 * | 5/2002 | Nosenchuck | 392/384 |
| 6,966,125 | B2 | 11/2005 | Rago et al. | |
| 7,124,763 | B2 | 10/2006 | Hafemann | |
| 7,586,066 | B2 * | 9/2009 | Bell | 219/678 |
| 2003/0196344 | A1 * | 10/2003 | Park | 34/96 |
| 2005/0108890 | A1 * | 5/2005 | Park | 34/96 |
| 2006/0207625 | A1 * | 9/2006 | Chan | 132/224 |
| 2007/0119069 | A1 * | 5/2007 | Shim | 34/96 |
| 2010/0212177 | A1 * | 8/2010 | Chen | 34/97 |

FOREIGN PATENT DOCUMENTS

| | | | |
|---|---|---|---|
| DE | 4236537 | A1 * | 4/1994 |
| FR | 2754486 | A1 * | 4/1998 |
| GB | 2440116 | A * | 1/2008 |
| JP | 55150672 | A * | 11/1980 |
| WO | WO 9818122 | A1 * | 4/1998 |

* cited by examiner

*Primary Examiner* — Stephen M. Gravini
(74) *Attorney, Agent, or Firm* — Ramon L. Pizarro; Edwin W. Crabtree

(57) ABSTRACT

A hand-held hair dryer and hair styling system that uses a magnetic field to index the location of a brush or combing device relative to the nozzle of the hair dryer is disclosed. The system allows the nozzle to follow the brush or combing device. The system includes a hair dryer that has a fan and a heating element, the fan forcing air over the heating element. The dryer also has a nozzle with ferrous or magnetic components, and that is supported from the body by bearings that allow rotation of the nozzle about a central axis. The system includes a brush that includes a magnet that provides a magnetic field that attracts or repels the magnetic or ferrous components of the nozzle, so that holding the hair dryer next to the comb causes the nozzle and the brush to be coupled through the magnetic field, so that the nozzle rotates or moves in response to movement of the brush.

11 Claims, 4 Drawing Sheets

MAGNETICALLY DIRECTED HAIR DRYER NOZZLE

BACKGROUND OF THE INVENTION (a) Field of the Invention

This application relates to a device and method for directing heated air from a hair dryer onto the hair while brushing or combing the hair. More particularly, but not by way of limitation, to a hair dryer with a pivoting nozzle that follows a brush or combing device. The position of the nozzle relative to the brush is preferably controlled through magnetic attraction.

(b) Discussion of Known Art

Known art addresses various problems associated with the styling of hair while using a blow dryer to dry the hair. Many of these, however, concern themselves with diffusing the flow of air in order to prevent hot spots that can over-dry or damage the hair. Diffusers are also helpful in styling because they distribute the airflow over a large region, thus making it easier for the user keep the brush or comb within the area covered by the flow of heated air. However, by diffusing the air, the efficiency and effectiveness of the dryer is greatly diminished. Also, the lack of focus of the air stream from a diffuser will cause the areas of the hair to dry before the user has had an opportunity to brush the hair.

A hair dryer with an oscillating nozzle is shown U.S. Pat. No. 6,966,125 to Rago et al. The Rago et al. device, however, causes the nozzle to oscillate at set rates, without concern for the area of the hair being brushed. Accordingly, the user must try to coordinate the brushing or styling with the movement of the nozzle, which can be particularly difficult if the user is holding the dryer with one hand and using the other hand to brush the hair that is on the same side as the dryer.

Accordingly, a review of known art reveals that there is a need for a device or system that allows a user to coordinate the flow from a blow dryer and a brush or other styling tool being used in conjunction with the blow dryer.

SUMMARY

It has been discovered that the problems left unanswered by known art can be solved by providing a hairdryer or blow dryer and brush system that includes:

A blow dryer having a body and a nozzle that is pivotally mounted from the body;

A hair brush or comb that includes a magnet that produces a magnetic field; and

An indexing system that aligns the nozzle with the brush or comb by detecting the magnetic field of the magnet, so that movement of the brush or comb across the hair while pointing the blow dryer towards the user's head causes the nozzle to point towards the comb, thereby It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

Figure 7A:
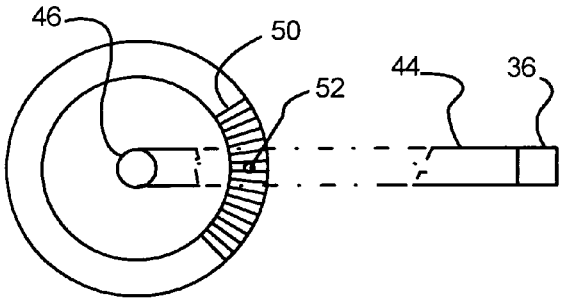
FIG. 7A illustrates the use of an electrical contact-type mechanism for detecting the angle of a pointer relative to the body of the hair dryer in order to cause a motor to rotate the nozzle until it aligns with the pointer.
Figure 7B:
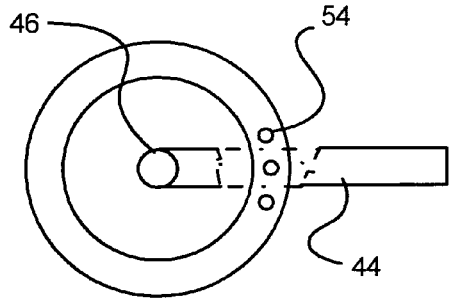

FIG. 7B I illustrates the use of a photoelectric-type mechanism for detecting the angle of a pointer relative to the body of the hair dryer in order to cause a motor to rotate the nozzle until it aligns with the pointer.

Figure 7C:
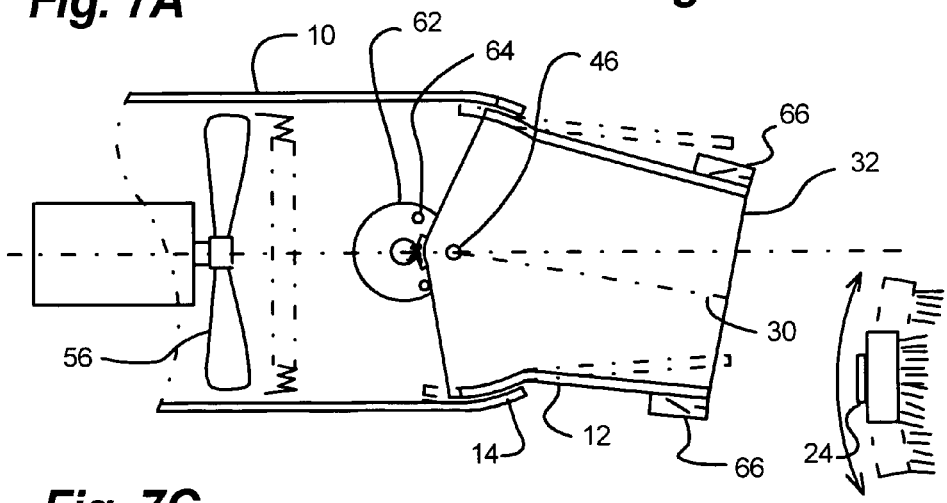

FIG. 7C illustrates the use of a ferrous or magnetic switches that are activated by the proximity of the ferrous or magnetic elements of the brush relative to the body of the hair dryer in order to cause a motor to rotate the nozzle until the nozzle reaches a stop switch.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
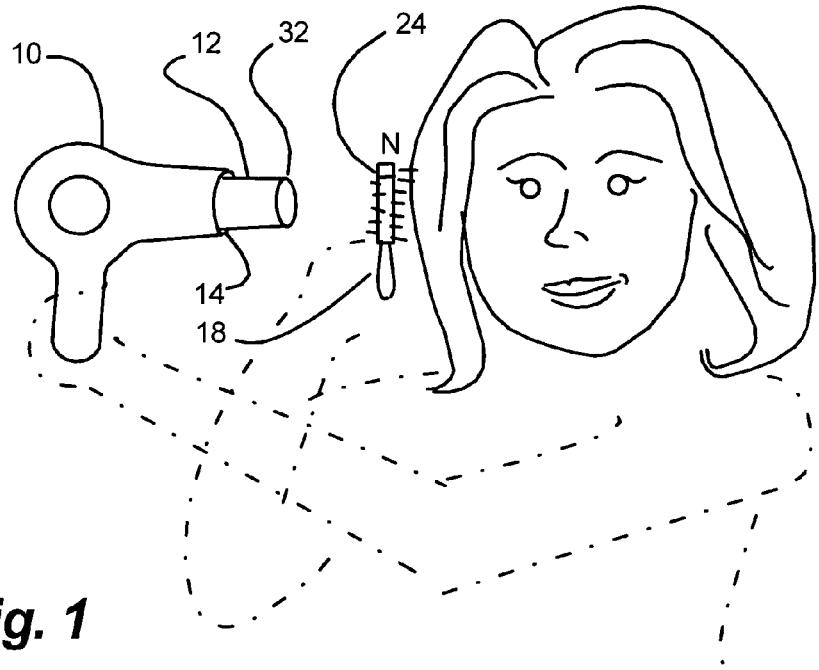
FIG. 1 illustrates the disclosed invention in use.
Figure 2A:
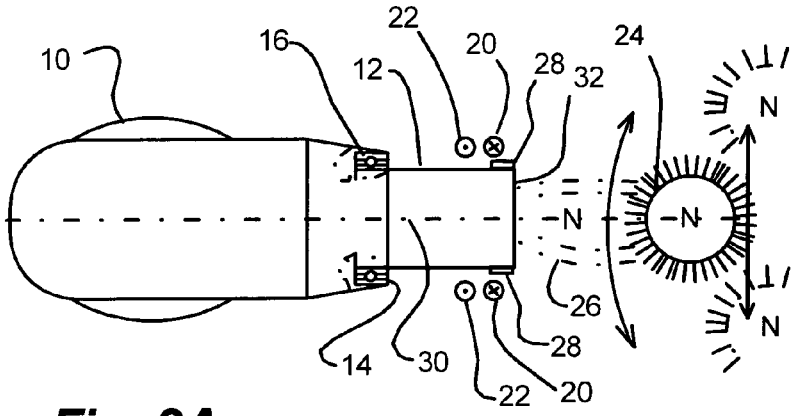
FIG. 2A is a view looking down at an example of the blow dryer and brush or comb, and illustrates axial movement of the nozzle relative to the brush or comb across the front of the nozzle, the view including a cut-away section showing the use of bearings to allow the nozzle to rotate.
Figure 2B:
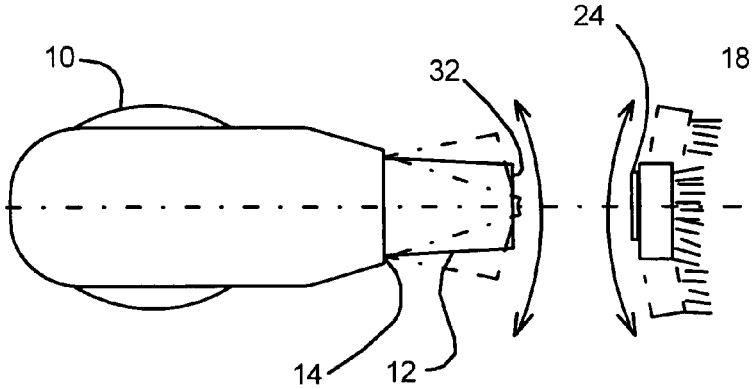
FIG. 2B is a view looking down at another example of the blow dryer and brush or comb using the inventive principles taught herein, and illustrates side-to-side movement of the nozzle relative to the brush or comb, and illustrates the use of a flat brush instead of a round brush as illustrated in FIGS. 2A and 3.

Turning now to FIGS. 1 and 2A where a hairdryer or blow dryer 10 incorporating inventive principles taught herein has been illustrated. In the example illustrated in FIG. 2A a hollow nozzle 12 that includes a central axis 30 and an exit end 23. The nozzle 12 rotates about the central axis 30 through bearings 16 that support the nozzle 12 and allow the nozzle 12 to rotate either clockwise or counterclockwise about the central axis 30 of the nozzle, as indicated by the arrow tail indicia 20 or arrow head indicia 22 shown in FIG. 2A. It will be understood that it is contemplated that the blow dryer 10 is used in conjunction with a comb or brush 18 that includes at least one magnet 24 that creates a magnetic field 26 that is used to control the movements of the nozzle 12 relative to the body 40 of the blow dryer 10.

Figure 3:
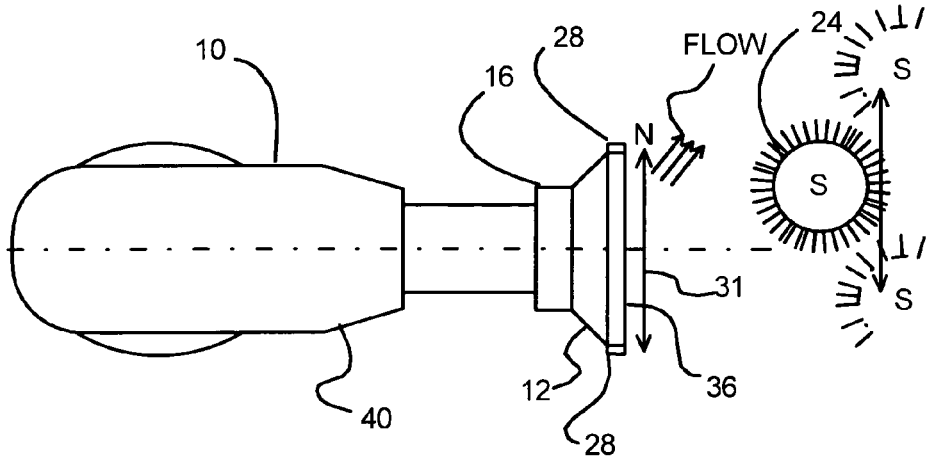
FIG. 3 illustrates an arrangement that uses an elongated that uses axial rotation, such as enabled by the bearings illustrated in FIG. 2A.
Figure 4:
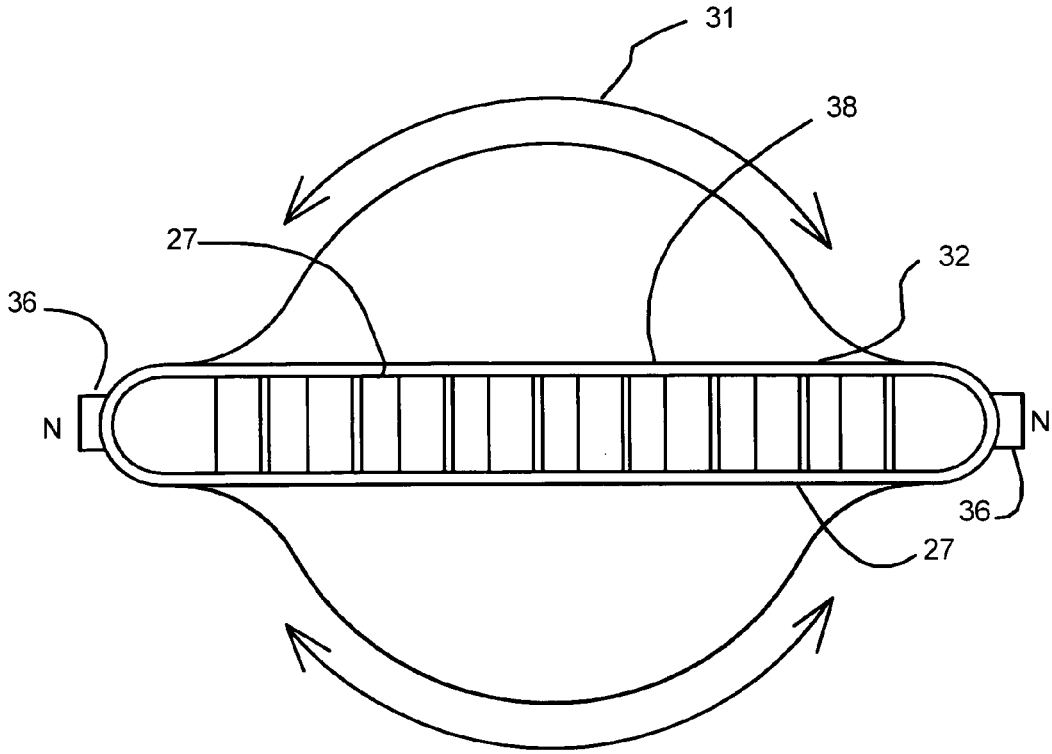
FIG. 4 is a view looking into the elongated nozzle, towards the body of the hair dryer, the nozzle using the arrangement of the type illustrated in FIG. 2A to accomplish rotation.

Turning now to FIGS. 3 and 4 it will be understood that it is contemplated that once the nozzle 12 has been mounted on bearings 16, as illustrated in FIG. 2A, and then use magnets 28 to then link through the magnetic field 26 to the brush 18. As shown on FIG. 4, the nozzle 12 will respond to the movement of the brush 18 past the nozzle 12 by rotating about the axis 30 of the nozzle 12, as indicated by the arrows 31. The flow from the elongated shape 25 of this example of the nozzle 12 will be directional due to the use of slats 27 and the elongated shape 25 illustrated in FIG. 4. The elongated shape combined with the use of the slats will result in a focused stream that will be shifted as the flow follows towards the brush. The elongated shape will include ends 29 and sides 38.

Figure 5:
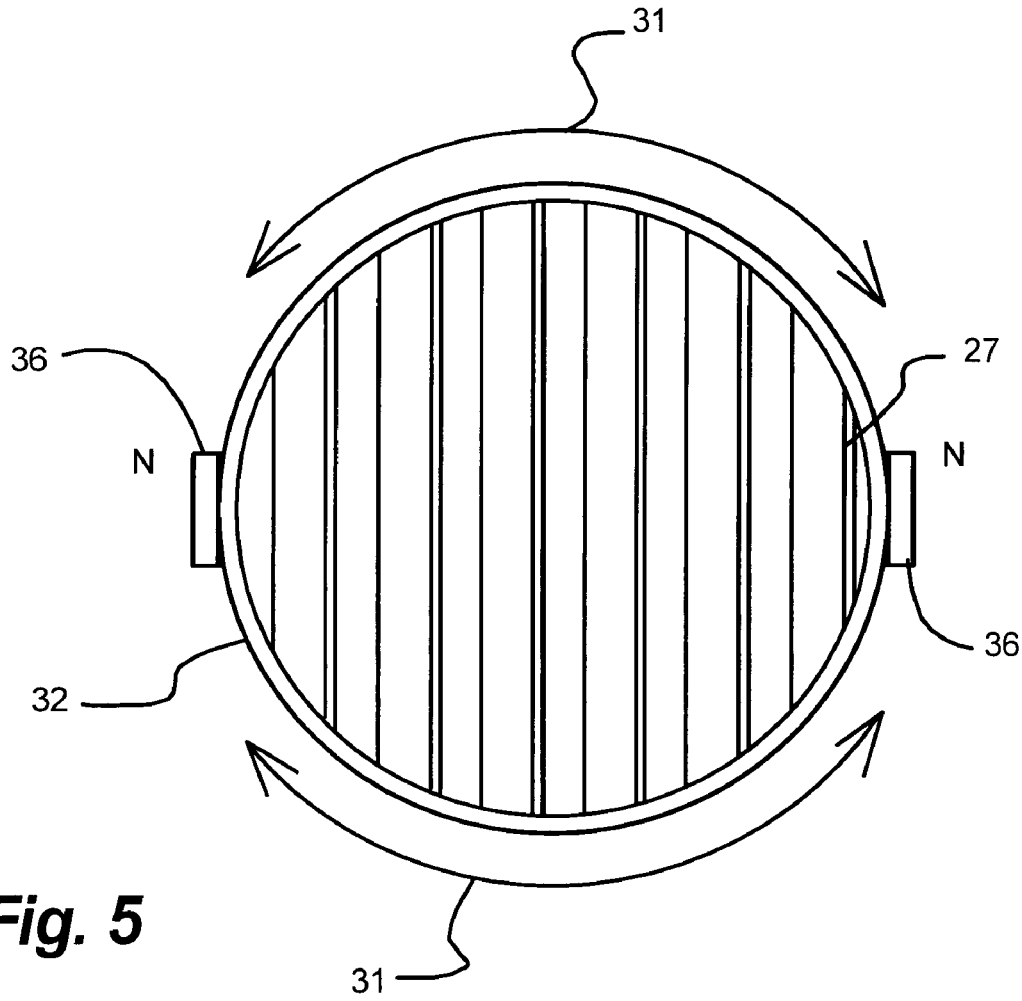
FIG. 5 is a view looking into a rounded nozzle, towards the body of the hair dryer, the nozzle using the arrangement of the type illustrated in FIG. 2A to accomplish rotation.

FIG. 5 illustrates the use of a rounded nozzle that also includes slats 27. This arrangement will use bearings that allow the nozzle 12 to rotate about the axis 30 of the nozzle 12. A perceived disadvantage of the rounded nozzle of FIG. 5 versus the elongated nozzle of FIG. 4 is the focusing that is achieved with the combination of the slats 27 and the elongated shape.

FIGS. 6, 7A, 7B, and 7C illustrate that it is also contemplated that the principles taught herein may also be embodied in a device where the nozzle pivots about a vertical axis. In this arrangement the blow dryer assembly 10 includes a pivoted nozzle 12 that is mounted at the exit 14 of the blow dryer 10. As in the examples illustrated in FIGS. 1-5, the blow dryer 10 is used in conjunction with a comb or brush 16 that includes at least one magnet 24 that creates a magnetic field 20 that is used to control the direction of orientation of the nozzle 12.

Because the linking is carried out through a magnetic field 26, it is contemplated that the magnet generating the magnetic field may be placed on the brush or the nozzle and a ferrous mating element placed on the mating nozzle or brush. It is contemplated that ferrous element may be the material that is used to form the nozzle 12 or incorporated into the tip 36 of the nozzle 12. If a sufficiently powerful magnet is imbedded into the brush 16, the magnetic field generated from the magnet may be used to keep the nozzle 12 pointed towards the brush 18 while combing or styling. However, the use of magnets on both the nozzle and the brush is a preferred embodiment because the use of magnets on each of the components results in an overlap of the magnetic fields. This overlap results in a stronger coupling of the two elements, and thus obviates the need for the use of exceptionally strong, more expensive, magnets.

Turning now to FIGS. 6, and 7A-7C, where nozzle is shown supported from the body 40 of the blow dryer 10 through a hinge 30 that acts along a single hinge line that is oriented along a vertical axis. The nozzle 12 is located downstream of a fan 44 that forces air past a heating element 60 as the air 34 flows towards the nozzle 12.

While the magnetic coupling disclosed here may be used to pivot the nozzle of this example, it is also contemplated that a system for assisting the movement of the nozzle 12 may also be utilized. Thus, FIGS. 6, and 7A-7C show how the magnetic coupling is used with a power assist mechanism 62 to allow the nozzle 12 to follow the magnetic field 26 that emanates from the brush 18.

Figure 6:
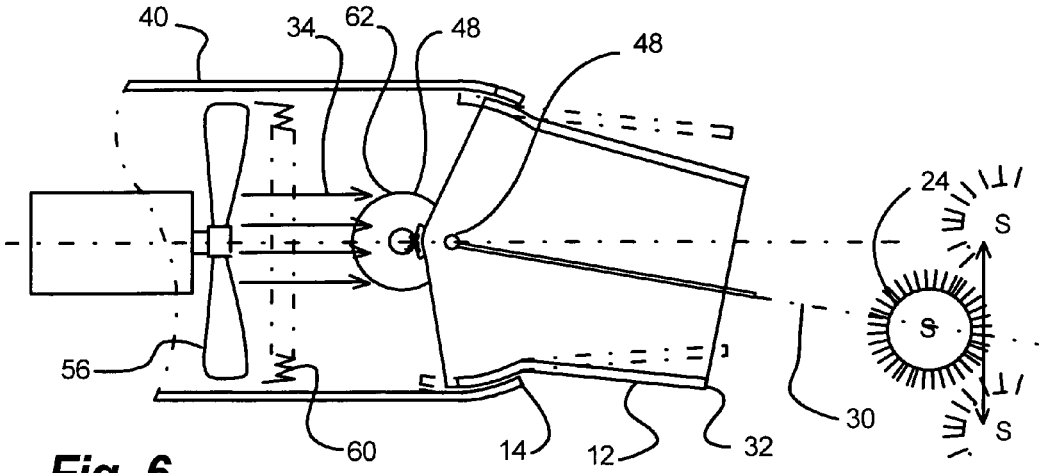
FIG. 6 illustrates a mechanism to oscillate the nozzle in the manner illustrated in FIG. 2B, the mechanism using a pointer to create information of the location of the brush relative to the body of the hair dryer.

FIG. 6 illustrates that the ferrous element 36 may be a part of a pointer 44 that is supported by a hinge 42 in the nozzle 12. Thus, the pointer 44 will be drawn to the magnetic field 26, and the orientation of the pointer 44 may be used to generate a control signal that is used to activate a motor 48 that moves the nozzle 12 until the central axis 30 of the nozzle 12 is aligned with the pointer 44. The control of the motor may be accomplished in various ways. For example, in FIG. 7A a system that uses various position contacts 50 that are brought into contact with a pointer contact 52 as the pointer 44 moves over the position contacts 50 allow the flow of an electrical current from the pointer contact 52 through the position contacts 44 to create a signal that is either proportionate to the angle of the pointer 44 or which corresponds to flow through a specific position contact 50.

Turning to FIG. 73, it will be understood that it is also contemplated that the electrical signal that is used to control the motor 48 may also be generated through the use of photocells 54, which would stop producing an electrical signal once the pointer 44 is directly over and thus covering the photocell 54, which works on the well-known photovoltaic effect. Accordingly, the lack of an electrical signal could then be used as a signal to activate the motor 48 in order to move the nozzle 12 until it is aligned with the pointer 44.

FIG. 7C illustrates that stop switches 64 may also be used to stop the movement of the nozzle 12 once the nozzle reaches the end of the desired travel. The switches would simply open the electrical circuit to the motor 36. Additionally, FIG. 7C shows the use of direction switches 58 that turn on electrical power to the motor 48 to achieve rotation towards the side of the respective direction switch 58. Thus, it is contemplated that as the brush is moved next to the direction switch 58, the direction switch 58 will cause the motor to rotate in the direction of the respective switch until the stop switch 64 is tripped. Then, once the magnetic field of the brush 16 passes over another direction switch 58, the motor 36 will then cause the nozzle to rotate in the direction of the most recently encountered direction switch 58 until another stop switch 64 is encountered.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A hand-held hair dryer and hair styling system comprising:

A body having a fan and a heating element, the fan forcing air over the heating element;

A nozzle, the nozzle being supported from the body by bearings that allow rotation of the nozzle about a central axis, the nozzle being at least partially composed of a ferrous material; and A brush having a body supporting a magnet that provides a magnetic field, so that holding the hair dryer next to the comb causes the nozzle and the brush to be coupled through the magnetic field, so that the nozzle rotates in response to movement of the brush.

2. A system according to claim 1 wherein said ferrous material is a permanent magnet.

3. A system according to claim 2 wherein said magnet on the brush is a permanent magnet.

4. A system according to claim 1 wherein said nozzle has an elongated exit with slats, and said ferrous material is a pair of magnets that are on opposite sides of said central axis.

5. A hand-held styling system comprising:

A hair dryer having a body having a fan and a heating element, the fan forcing air over the heating element;

A hollow nozzle, the hollow nozzle having a central axis and an exit end, the nozzle being attached to the body through a pivotal support, the nozzle further comprising at least one magnet near the exit of the nozzle; and A brush having a body supporting a magnet, the magnet being positioned on the brush such that holding the hair dryer next to the comb causes the nozzle and the brush to be coupled through the magnetic field, so that the exit of the nozzle follows a movement of the brush when using the combing system.

6. A hand-held styling system according to claim 5 wherein said pivotal support is a bearing that allows the nozzle to move relative to the body.

7. A hand-held styling system according to claim 6 wherein said nozzle is connected to the along a vertical axis that is normal to the central axis.

8. A hand-held styling system according to claim 6 wherein said bearing surrounds the central axis and allows the nozzle to rotate about the central axis.

9. A hand-held styling system according to claim 7 and further comprising a motor that is coupled to the nozzle, and a switch that responds to the magnetic field from the brush, the switch being electrically connected to the motor in order to activate the motor in response to movement of the magnetic field and thereby moving the nozzle in response to movement of the brush.

10. A hand-held hair dryer and styling system comprising:

A body having a fan and a heating element, the fan forcing air over the heating element;

A hollow nozzle, the hollow nozzle having a central axis and an exit and is supported from the body by at least one bearing that allows the nozzle to rotate about the central axis, the nozzle a pair of magnets positioned by the exit of the nozzle with the central axis being positioned between the pair of magnets; and A brush having a body supporting a magnet having a magnetic field, so that holding the hair dryer next to the comb causes the nozzle and the brush to be coupled through the magnetic field, so that movement of the brush causes movement of the nozzle.

11. A system according to claim 10 and further comprising a motor that is connected to the hollow nozzle to rotate the nozzle, and a switch positioned near the exit of the nozzle, the switch tripping in response to movement of the magnetic field relative to the switch, so that the nozzle is moved in response to movement of the brush.

* * * * *